US009473840B2

(12) United States Patent
Akino

(10) Patent No.: US 9,473,840 B2
(45) Date of Patent: Oct. 18, 2016

(54) DYNAMIC HEADPHONE UNIT AND METHOD OF PRODUCING DYNAMIC HEADPHONE UNIT

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 88 days.

(21) Appl. No.: 14/510,413

(22) Filed: Oct. 9, 2014

(65) Prior Publication Data

US 2015/0124992 A1 May 7, 2015

(30) Foreign Application Priority Data

Nov. 5, 2013 (JP) ..... 2013-228970

(51) Int. Cl.

| | |
|---|---|
| ***H04R 1/10*** | (2006.01) |
| ***H04R 1/06*** | (2006.01) |
| ***H04R 7/00*** | (2006.01) |
| ***H04R 7/12*** | (2006.01) |
| ***H04R 7/14*** | (2006.01) |

(52) U.S. Cl.

CPC *H04R 1/06* (2013.01); *H04R 1/10* (2013.01); *H04R 7/00* (2013.01); *H04R 7/127* (2013.01); *H04R 7/14* (2013.01)

(58) Field of Classification Search

USPC ..... 381/74

See application file for complete search history.

(56) References Cited

U.S. PATENT DOCUMENTS

| | | | | |
|---|---|---|---|---|
| 2007/0053547 | A1* | 3/2007 | Ando | H04R 9/06 381/430 |
| 2008/0069393 | A1* | 3/2008 | Babb | H04R 9/06 381/423 |
| 2013/0011001 | A1* | 1/2013 | Fujimori | H04R 31/006 381/413 |

FOREIGN PATENT DOCUMENTS

| | | |
|---|---|---|
| JP | 2003-153383 A | 5/2003 |

* cited by examiner

*Primary Examiner* — Quynh Nguyen

(74) *Attorney, Agent, or Firm* — Whitham, Curtis & Cook, P.C.

(57) ABSTRACT

A dynamic headphone unit includes a diaphragm to which a voice coil is fixed, a permanent magnet, a pole piece disposed adjacent one of the magnetic poles of the permanent magnet, and a yoke disposed adjacent the other magnetic pole of the permanent magnet. The pole piece and the yoke define a magnetic gap therebetween, and the voice coil is vibratably supported by the diaphragm in the magnetic gap. The voice coil includes a lead line for transmitting signal current. The lead line is bonded to the inner surface of a peripheral dome of the diaphragm with a pressure-sensitive adhesive.

6 Claims, 5 Drawing Sheets

DYNAMIC HEADPHONE UNIT AND METHOD OF PRODUCING DYNAMIC HEADPHONE UNIT

TECHNICAL FIELD

The present invention relates to a dynamic headphone unit and a method of producing the dynamic headphone unit.

BACKGROUND ART

A typical dynamic headphone unit includes a permanent magnet, a pole piece, and a yoke. The pole piece is disposed adjacent one of the magnetic poles of the permanent magnet, whereas the yoke is disposed adjacent the other magnetic pole of the permanent magnet. The permanent magnet, the pole piece, and the yoke define a magnetic circuit having a magnetic gap. The magnetic gap accommodates a voice coil vibratably supported by a diaphragm. If current flows through the voice coil in response to audio signals, the interaction between the magnetic field caused by the current and the magnetic field in the magnetic gap vibrates the voice coil. The vibrations of the voice coil correspond to the audio signals. The diaphragm vibrates with the voice coil. That is, the diaphragm vibrates in response to the audio signals to output sound. The dynamic headphone unit further includes a line (hereinafter referred to as "lead line") for transmitting the audio signals to the voice coil.

The diaphragm of the dynamic headphone unit has a large displacement. The voice coil is fixed to the diaphragm; hence, the displacement of the diaphragm leads to a large displacement of the lead line being a part of the voice coil. The lead line is thin and thus is readily broken by a large displacement. In other words, the lead line is readily subject to disconnection. If the lead line is not firmly fixed, the lead line vibrates like a skipping rope in response to the vibrations of the diaphragm. Such vibrations of the lead line cause noise.

FIG. 4 is a cross-sectional view of a conventional dynamic headphone unit along the direction of displacement of the diaphragm. In FIG. 4, a magnetic circuit in the dynamic headphone unit is not depicted. As illustrated in FIG. 4, the dynamic headphone unit includes a diaphragm 11, which includes a central dome 12 and a peripheral dome 13 around the central dome 12. A voice coil 14 is fixed in the vicinity of the boundary between the central dome 12 and the peripheral dome 13.

A lead line 15 is connected to a portion of the voice coil 14. The lead line 15 is also connected to a signal input circuit (not shown). The lead line 15 is connected to the signal input circuit at a node A, and is connected to the voice coil 14 at a node B. The vibratory lead line 15 can readily be disconnected at the nodes A and B. The lead line 15 sometimes vibrates like a skipping rope around the nodes A and B. Such vibrations of the lead line 15 cause noise.

In order to prevent the disconnection of and the noise from the lead line, the vibrations of the lead line should be reduced. In a known dynamic headphone unit, lead lines connected to a wire end of the voice coil are twisted and thus strengthened (for example, refer to Japanese Unexamined Patent Application Publication No. 2003-153383). In another known dynamic headphone unit, the lead line is fixed to the inner surface (rear surface) of the peripheral dome such that the lead line does not vibrate.

The lead line is fixed to the rear surface of the peripheral dome, for example, by bonding the lead line to the peripheral dome with an adhesive. The bonded state will now be described. FIG. 5 illustrates an exemplary conventional dynamic headphone unit in which a lead line is firmly bonded to the rear surface of a peripheral dome. With reference to FIG. 5, an adhesive 17 is applied to the peripheral dome 13 to bond the lead line 15 to the peripheral dome 13. A corrugation 18 is formed on the peripheral dome 13.

In a conventional technique to fix the lead line as illustrated in FIG. 5, a part of the lead line 15 extends over or intersects some corrugations 18 at the outer periphery of the peripheral dome 13. Such a conventional technique to fix the lead line 15 can reduce the loads on the lead line 15 caused by the displacement of the peripheral dome 13. The lead line 15 is fixed to the peripheral dome 13 through the curing of the adhesive 17. The adhesive 17 thus stiffens a part of the peripheral dome 13 that is bonded to the lead line 15 (coated with the adhesive 17).

SUMMARY OF INVENTION

Technical Problem

As is described above with reference to FIG. 5, in the conventional dynamic headphone unit, the fixation of the lead line of the voice coil leads to partial stiffening of the diaphragm. The peripheral dome determines the restoring force of the diaphragm. Unfortunately, the partly stiffened peripheral dome has an uneven restoring force. The uneven restoring force of the peripheral dome leads to uneven vibrations of the entire diaphragm. In addition, the diaphragm has uneven mass distribution caused by the mass of the adhesive 17. The diaphragm thus provides undulating rolling vibrations.

The diaphragm is composed of a thin film having a thickness of approximately 50 μm. The adhesive for fixing the lead line is coated with a brush. Unfortunately, the brush cannot readily produce a thin layer of the adhesive. It is significantly difficult to apply the adhesive into a small thickness of approximately 50 μm. As is described above, the peripheral dome has uneven mass distribution (includes higher-mass portions) due to the mass of the adhesive for fixing the lead line, resulting in rolling vibrations of the diaphragm around the central dome.

In the conventional dynamic headphone unit, the fixation of the lead line adversely affects vibrations of the diaphragm. The rolling vibrations of the diaphragm impair the quality of the output sound and cause noise.

The lead line that is not fixed can be disconnected or cause noise, as described above; hence, the lead line must be fixed. The lead line should desirably be fixed by a means that does not adversely affect the restoring force or mass distribution of the peripheral dome 13.

Solution to Problem

An object of the invention is to provide a dynamic headphone unit including a diaphragm including a peripheral dome that has a uniform restoring force and mass distribution regardless of the bonding of a lead line to the inner surface of the peripheral dome.

A dynamic headphone unit according to one aspect of the invention includes: a diaphragm including a peripheral dome at the outer periphery; a voice coil fixed to the diaphragm, the voice coil including a lead line for transmitting signal current to the voice coil; a permanent magnet; a pole piece disposed adjacent one of the magnetic poles of the permanent magnet; and a yoke disposed adjacent the other magnetic pole of the permanent magnet, wherein the pole piece and the yoke define a magnetic gap therebetween, the voice coil is vibratably supported by the diaphragm in the magnetic gap, and the lead line is bonded to the inner surface of the peripheral dome of the diaphragm with a pressure-sensitive adhesive.

A method of producing a dynamic headphone unit according to another aspect of the invention is directed to a dynamic headphone unit including a diaphragm including a peripheral dome at the outer periphery, a voice coil fixed to the diaphragm and including a lead line for transmitting signal current to the voice coil, a permanent magnet, a pole piece disposed adjacent one of the magnetic poles of the permanent magnet, and a yoke disposed adjacent the other magnetic pole of the permanent magnet, the pole piece and the yoke defining a magnetic gap therebetween, the voice coil being vibratably supported by the diaphragm in the magnetic gap. The method includes: extracting the lead line from the diaphragm; applying an adhesive onto the lead line; and bringing the lead line coated with the adhesive into contact with the inner surface of the peripheral dome along the shape of the peripheral dome.

Advantageous Effects of Invention

The invention can attain a uniform restoring force and mass distribution of the peripheral dome of the diaphragm regardless of the bonding of the lead line to the inner surface of the peripheral dome.

DESCRIPTION OF EMBODIMENTS

Figure 1:
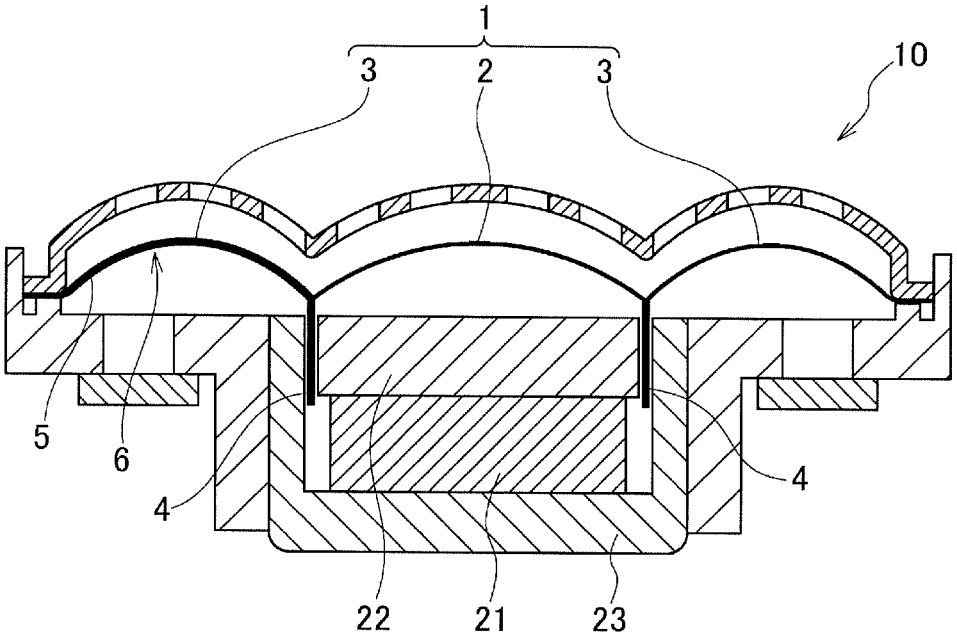
FIG. 1 is a cross-sectional view of a dynamic headphone unit according to an embodiment of the invention.

A dynamic headphone unit according to an embodiment of the invention will now be described with reference to the drawings. FIG. 1 is a cross-sectional view of the dynamic headphone unit 10 according to the embodiment of the invention. With reference to FIG. 1, the basic configuration of a dynamic headphone unit 10 includes a diaphragm 1, a permanent magnet 21, a pole piece 22, and a yoke 23. The pole piece 22 is disposed adjacent one of the magnetic poles of the permanent magnet 21, whereas the yoke 23 is disposed adjacent the other magnetic pole of the permanent magnet 21. The yoke 23 has a cup shape, and the pole piece 22 is disposed inside the yoke 23. The permanent magnet 21, the pole piece 22, and the yoke 23 define a magnetic circuit. The pole piece 22 and the yoke 23 define a magnetic gap therebetween. The magnetic gap accommodates a voice coil 4 supported by the diaphragm 1. The voice coil 4 is not in contact with the pole piece 22 or the yoke 23, so that the voice coil 4 can vibrate along the depth of the magnetic gap inside the magnetic gap (i.e., a direction orthogonal to a direction of magnetic flux passing through the magnetic gap).

The diaphragm 1 includes a central dome 2 at the center and a peripheral dome 3 around the central dome 2. The voice coil 4 is fixed to the inner surface (rear surface) of the diaphragm 1 in the vicinity of the boundary between the central dome 2 and the peripheral dome 3. The outer peripheral edge of the peripheral dome 3 is supported by a housing of the dynamic headphone unit 10.

The voice coil 4 vibrates in response to current reflecting the audio signals. The voice coil 4 vibrates along the depth of the magnetic gap, i.e., the vertical direction in FIG. 1. The outer peripheral edge of the diaphragm 1 is supported by the housing of the dynamic headphone unit 10. Thus, vibrations of the voice coil 4 lead to vibrations of the central dome 2 of the diaphragm 1 in the vertical direction in FIG. 1. The vibrations convert the audio signals into sound waves to be outputted.

An end of the wire constituting the voice coil 4 functions as a lead line 5 for transmitting signal current reflecting audio signals to the voice coil 4. The lead line 5 is bonded to the inner surface of the peripheral dome 3. The lead line 5 is connected to a signal input circuit such as an audio signal amplifier circuit (not shown).

Figure 2A:
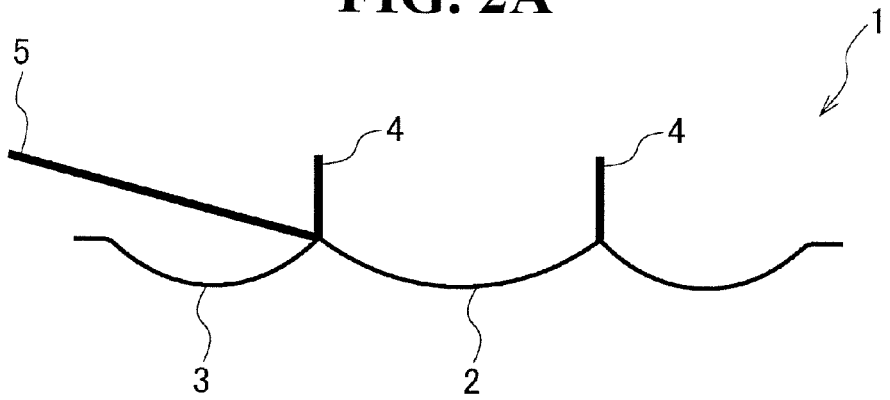
FIG. 2A illustrates a first step of an exemplary process of bonding a lead line to a diaphragm in a dynamic headphone unit according to the embodiment.
Figure 2B:
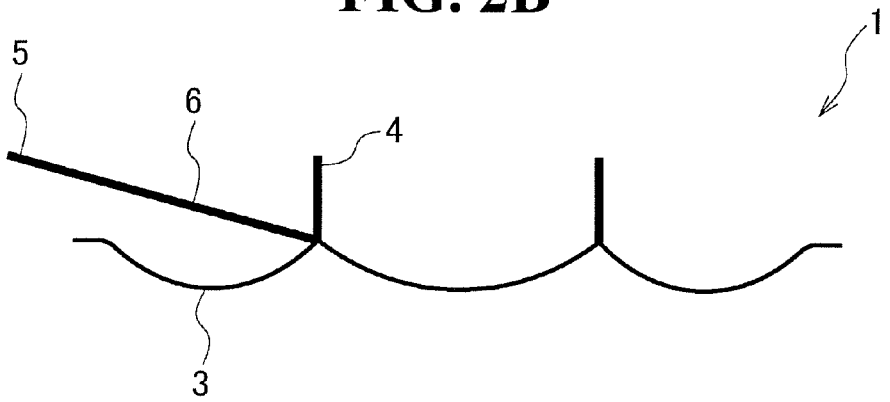
FIG. 2B illustrates a second step of the exemplary process of bonding a lead line to a diaphragm in a dynamic headphone unit according to the embodiment.

FIG. 2 illustrates an exemplary bonding process of the lead line 5 to the diaphragm 1. FIG. 2 is an inverted view of the diaphragm 1 illustrated in FIG. 1. With reference to FIG. 2A, the lead line 5 of the voice coil 4 fixed to the diaphragm 1 is extracted from the peripheral dome 3. With reference to FIG. 2B, the surface of the lead line 5 is then coated with a pressure-sensitive adhesive 6. The pressure-sensitive adhesive 6 is aqueous, and should preferably be an adhesive for screen printing, for example. The pressure-sensitive adhesive 6 is applied onto the lead line 5 with a brush.

Figure 2C:
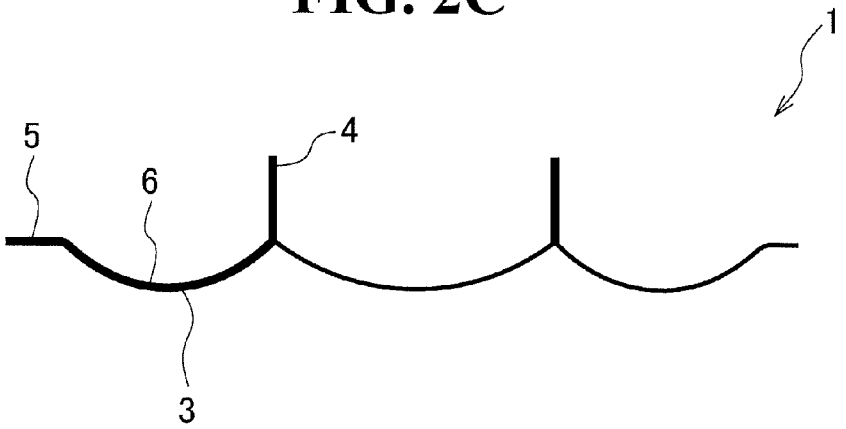
FIG. 2C illustrates a third step of the exemplary process of bonding a lead line to a diaphragm in a dynamic headphone unit according to the embodiment.

With reference to FIG. 2C, the lead line 5 coated with the pressure-sensitive adhesive 6 is then brought into contact with the inner surface of the peripheral dome 3.

While the lead line 5 is in contact with the inner surface of the peripheral dome 3, the lead line 5 is urged against the peripheral dome 3. For example, the lead line 5 may be lightly urged with a jig, or a weak wind such as an exhaled breath. Under the urging force, the lead line 5 and the pressure-sensitive adhesive 6 applied thereon are urged against the rear surface of the peripheral dome 3. The pressure thus bonds the lead line 5 onto the peripheral dome 3. This process fixes the lead line 5 along the shape of the peripheral dome 3.

Figure 3:
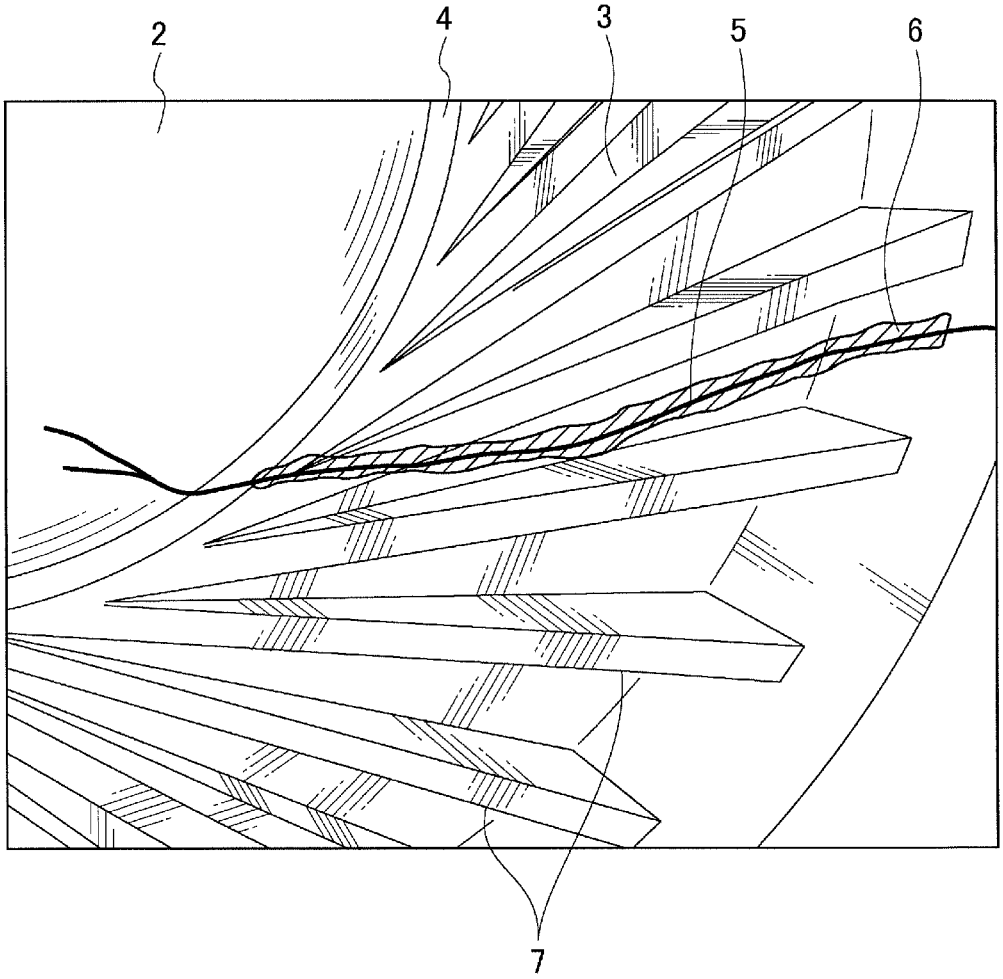
FIG. 3 is a plan view of a diaphragm to which a lead line is bonded in a dynamic headphone unit according to the embodiment.
Figure 4:
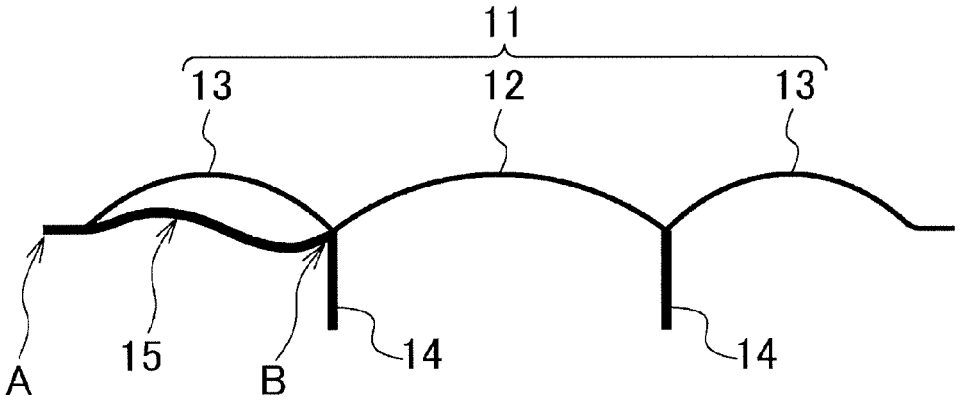
FIG. 4 RELATED ART
FIG. 4 illustrates an exemplary fixed lead line in a conventional dynamic headphone unit.
Figure 5:
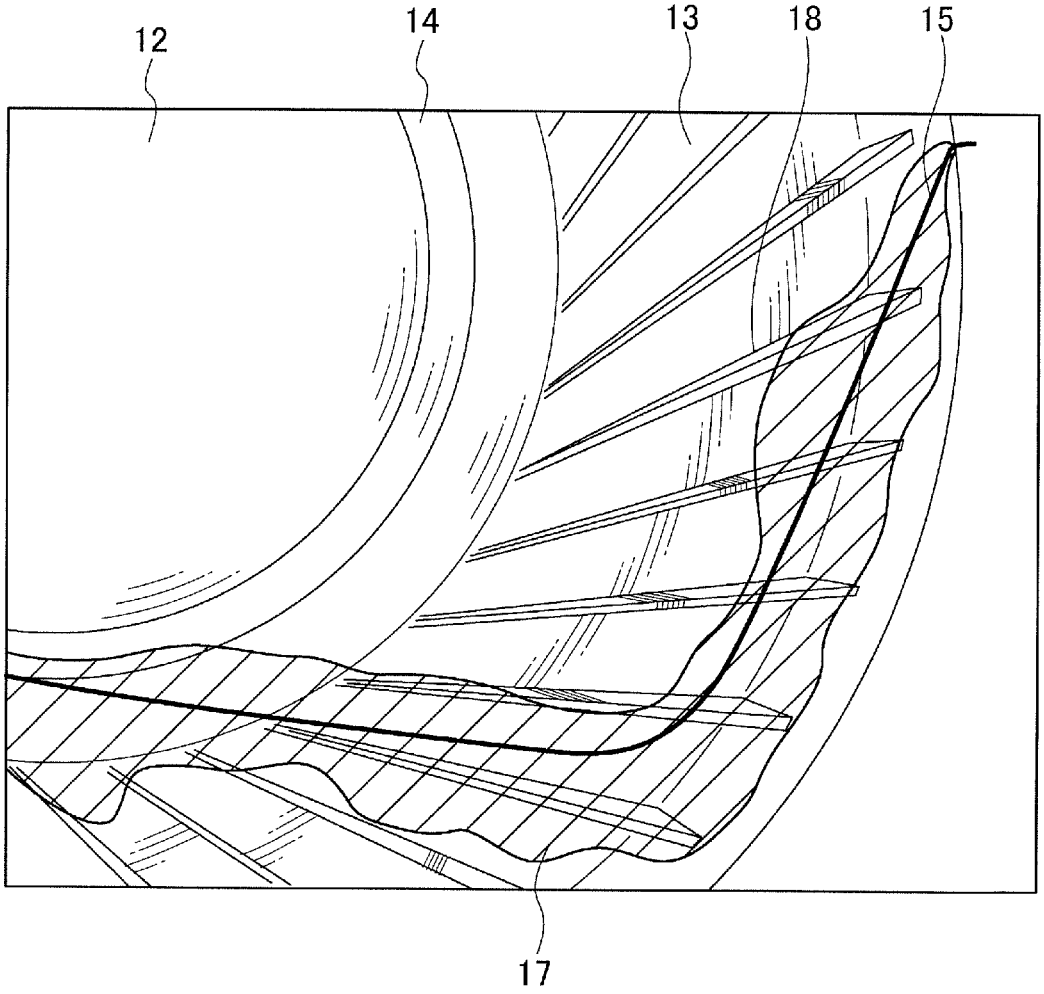
FIG. 5 RELATED ART
FIG. 5 illustrates an exemplary fixed lead line in a conventional dynamic headphone unit.

FIG. 3 is a plan view of an exemplary state of the diaphragm 1 to which the lead line 5 is bonded. The lead line 5 is coated with the pressure-sensitive adhesive 6 and lightly urged, as is explained above, so that the pressure-sensitive adhesive 6 barely spreads wider than the lead line 5, as illustrated in FIG. 3. In other words, the bonding of the lead line 5 to the peripheral dome 3 with the pressure-sensitive adhesive 6 exerts small effects on the peripheral dome 3. A corrugation 7 is formed on the peripheral dome 3. The lead line 5 is extracted along one of the corrugations 7 of the peripheral dome 3 and is bonded between any adjacent two of the corrugations 7.

The pressure-sensitive adhesive 6 is less readily hardened compared to a rubber adhesive used in a conventional dynamic headphone unit. The pressure-sensitive adhesive 6 is aqueous and thus barely forms a thick layer on the lead line 5. Because the adhesive is never excessively coated, uniform mass distribution of the diaphragm 1 of the dynamic headphone unit 10 can be achieved regardless of the use of the adhesive in the bonding of the lead line 5. The diaphragm 1 can also retain a uniform restoring force. The pressure-sensitive adhesive 6 has elasticity and long lasting adhesion. The elasticity allows the lead line 5 and the pressure-sensitive adhesive 6 to expand or contract in response to the displacement of the peripheral dome 3 regardless of the bonding of the lead line 5 along one of the corrugations 7 radially outward of the peripheral dome 3. This configuration 7 can prevent disconnection of the lead line 5 caused by the displacement of the peripheral dome 3.

As described above, the dynamic headphone unit 10 including the lead line 5 bonded to the inner surface of the peripheral dome 3 of the diaphragm 1 can prevent the disconnection of the lead line 5 and the occurrence of noise while achieving a uniform restoring force and mass distribution of the peripheral dome 3.

What is claimed is:

1. A dynamic headphone unit comprising:

a diaphragm comprising a peripheral dome at an outer periphery;

a voice coil fixed to the diaphragm, the voice coil comprising a lead line for transmitting signal current to the voice coil;

a permanent magnet;

a pole piece disposed adjacent one of the magnetic poles of the permanent magnet; and a yoke disposed adjacent the other magnetic pole of the permanent magnet, wherein the pole piece and the yoke define a magnetic gap therebetween, the voice coil is vibratably supported by the diaphragm in the magnetic gap, the lead line is urged against an inner surface of the peripheral dome of the diaphragm to be bonded to the inner surface with a pressure-sensitive adhesive, the lead line is bonded to the inner surface of the peripheral dome of the diaphragm with the pressure-sensitive adhesive, and the lead line is linearly bonded in a radially outward direction of the peripheral dome of the diaphragm.

2. The dynamic headphone unit according to claim 1, wherein the peripheral dome of the diaphragm comprises a plurality of corrugations, and the lead line is extracted along one of the corrugations and is fixed between any adjacent two of the corrugations.

3. The dynamic headphone unit according to claim 1, wherein the diaphragm includes a central dome at the center, the central dome surrounding the peripheral dome, and the voice coil is fixed to the inner surface of the diaphragm in the vicinity of the boundary between the central dome and the peripheral dome.

4. A method of producing a dynamic headphone unit comprising a diaphragm comprising a peripheral dome at an outer periphery, a voice coil fixed to the diaphragm and comprising a lead line for transmitting signal current to the voice coil, a permanent magnet, a pole piece disposed adjacent one of the magnetic poles of the permanent magnet, and a yoke disposed adjacent the other magnetic pole of the permanent magnet, the pole piece and the yoke defining a magnetic gap therebetween, the voice coil being vibratably supported by the diaphragm in the magnetic gap, the method comprising:

extracting the lead line from the diaphragm;

applying an adhesive onto the lead line;

urging the lead line against an inner surface of the peripheral dome using a wind; and bringing the lead line coated with the adhesive into contact with the inner surface of the peripheral dome along a shape of the peripheral dome.

5. The method of producing a dynamic headphone unit according to claim 4, wherein the adhesive is an aqueous pressure-sensitive adhesive.

6. The method of producing a dynamic headphone unit according to claim 4, wherein the lead line is linearly bonded in a radially outward direction of the peripheral dome of the diaphragm.

* * * * *